US006401489B1

(12) United States Patent
Cheng

(10) Patent No.: US 6,401,489 B1
(45) Date of Patent: Jun. 11, 2002

(54) GEMSTONE

(75) Inventor: Nai Yan Cheng, Kowloon (HK)

(73) Assignee: Continental Jewelry (USA), Inc., New York, NY (US)

( * ) Notice: Subject to any disclaimer, the term of this patent is extended or adjusted under 35 U.S.C. 154(b) by 0 days.

(21) Appl. No.: 09/781,662

(22) Filed: Feb. 12, 2001

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

| | | | | |
|---|---|---|---|---|
| D141,258 | S | | 5/1945 | Fine |
| D141,259 | S | | 5/1945 | Fine |
| 3,286,486 | A | | 11/1966 | Huisman et al. |
| 3,490,250 | A | | 1/1970 | Jones |
| 3,585,764 | A | | 6/1971 | Huisman et al. |
| 3,763,665 | A | | 10/1973 | Polakiewicz |
| 3,788,097 | A | | 1/1974 | Elbe |
| D231,793 | S | * | 6/1974 | Golay ..... D11/90 |
| 3,875,760 | A | | 4/1975 | Jones |
| 4,118,949 | A | | 10/1978 | Grossbard |
| D287,232 | S | | 12/1986 | Ishida |
| 5,462,474 | A | | 10/1995 | Hansen |
| 5,533,364 | A | | 7/1996 | Freilich |
| D373,551 | S | * | 9/1996 | Udko ..... D11/90 |
| 5,657,646 | A | | 8/1997 | Rosenberg |
| 5,657,647 | A | | 8/1997 | Freiesleben |
| D384,592 | S | | 10/1997 | Siman-Tov et al. |
| 5,761,929 | A | | 6/1998 | Freilich |
| D398,552 | S | | 9/1998 | Siman-Tov et al. |
| 6,006,548 | A | | 12/1999 | Freilich |
| D419,104 | S | | 1/2000 | Ceulemans |
| D431,492 | S | | 10/2000 | Wagemans |
| D442,880 | S | * | 5/2001 | Zimet et al. ..... D11/90 |

FOREIGN PATENT DOCUMENTS

| | | | | |
|---|---|---|---|---|
| SU | 1466691 | * | 3/1989 | ..... 63/32 |

OTHER PUBLICATIONS

Lily Cut® advertisement by Eternity Diamond Corporation of 580 5$^{th}$ Avenue, Suite 2012, New York NY 10036 date unknown.

* cited by examiner

*Primary Examiner*—Jack Lavinder
*Assistant Examiner*—Andrea Chop
(74) *Attorney, Agent, or Firm*—Baker Botts L.L.P.

(57) ABSTRACT

A gemstone includes a crown portion and a girdle portion abutting the crown portion and extending along a predetermined plane. The crown portion has a plurality of crown facets provided on a surface thereof. The crown portion and the girdle portion each have eight longitudinal sections. At least one of the eight longitudinal sections of the crown portion have a first facet of the crown facets having a first edge bordering the girdle portion, and a second facet of the crown facets having a second edge bordering the girdle portion. A particular portion of the first edge abuts the second edge at a particular location. The first and second edges curve toward a center of the gemstone which is provided on the particular plane. The particular location is closer to the center of the gemstone than another portion of the first edge.

18 Claims, 12 Drawing Sheets

GEMSTONE

FIELD OF THE INVENTION

The present invention relates to a gemstone which has a particular shape, and which has a particular number of facets on the crown, girdle, and pavilion portion thereof. In particular, the gemstone may have a shape of a sunflower or other similar shape.

BACKGROUND INFORMATION

Generally, facets on precious and semi-precious gemstones are cut so as to provide a brilliance to these gemstones in an economical manner. The way to cut the gemstones to provide particular facets thereon and the locations of these facets on the gemstones are well known in the art. FIGS. 1–4 show an exemplary illustration of a conventional gemstone 10 having a circular shape as viewed from top view (FIG. 4). However, it is possible that another embodiment of the gemstone 10 may have other shapes (e.g. an oval shape, a marquis shape, etc.). The conventional gemstone 10 has a prior art configuration of facets on the surface of the gemstone 10. In particular, FIG. 1 shows a side view of the conventional round-shaped gemstone 10. The conventional gemstone 10 includes a crown 20 and a pavilion 30. The crown 20 is provided above the pavilion 30, and is separated from the pavilion 30 by a girdle 40. The crown 20 and the pavilion 30 have particular facets provided thereon. As known to those having ordinary skill in the art, these facets are arranged to enhance the brilliance of the gemstone 10. FIG. 2 shows separate portions of the conventional gemstone 10, i.e., the crown 20, the pavilion and an enlarged illustration of the crown 40.

FIG. 3 shows an enlarged side view and FIG. 4 shows an enlarged top view of the crown 20 of the conventional gemstone 10. The crown 20 includes a flat table 50 which has a shape of an octagon and is disposed primarily in the horizontal plane on top of the crown 20. In addition, facets are provided on a diagonally extending side 25 of the crown 20. These facets include star facets 110 (each having a shape of a triangle), upper main facets 120 (each having four sides), left-side upper girdle facets 130 (each having a pointed end directed to the left side), and right-side upper girdle facets 140 (each having a pointed end directed to the right side). The crown generally has eight star facets 110, eight upper main facets 120, eight left-side upper girdle facets 130 and eight right-side upper girdle facets 140. Accordingly, the crown 20 has a total of thirty-two (32) facets and the table 50 (which can be considered as another facet) provided thereon.

The longest edges 115 of the star facets 110 form edges 55 of the table 50. A right edge 118 of each star facet 110 forms a shorter left edge 126 of a respective upper main facet 120. A left edge 117 of each star facet 110 forms a shorter right edge 128 of another upper main facet 120. A right edge 137 of each left-side upper girdle facet 130 forms a longer left edge 124 of a respective upper main facet 120, while a left edge 135 of the same left-side upper girdle facet 130 forms a longer right edge 122 of another upper main facet 120. Bottom edges 138 of the left-side upper girdle facets 130 and bottom edges 148 of the right-side upper girdle facets 140 collectively form an upper edge 45 of the girdle 40.

FIG. 5 shows an enlarged side view and FIG. 6 shows an enlarged bottom view of the pavilion 30 of the conventional gemstone 10. The pavilion 30 includes facets on a diagonally extending side 35 of the pavilion 30. These facets include left-side lower girdle facets 150 (each having a shape of a triangle), right-side lower girdle facets 160 (each having a shape of a triangle), and lower main facets 170 (each having four sides). The pavilion generally has eight left-side lower girdle facets 150, eight right-side lower girdle facets 160, and eight lower main facets 170. Accordingly, the pavilion 30 has a total of twenty-four (24) facets provided thereon.

Each of the left edge 157 of the left-side lower girdle facets 150 form the longer right edge 175 of the lower main facet. Each of the right edge 155 of the left-side lower girdle facets 150 form the left edge 165 of the right-side lower girdle facets 160. Each of the right edge 167 of the right-side lower girdle facet 160 form the longer left edge 176 of the lower main facet. Each of the shorter left edge 177 of the lower main facet 170 form the shorter right edge 178 of the lower main facet 170. Top edges 158 of the left-side lower girdle facets 150 and top edges 168 of the right-side lower girdle facets 160 form a lower edge of the girdle 40.

Using this configuration of the facets of the crown 20, is was possible to obtain a brilliance effect and appeal with the conventional gemstone 10 which was generally acceptable to a consumer.

SUMMARY OF THE PRESENT INVENTION

An object of the present invention is to provide a brilliance effect and appeal with a gemstone for a consumer.

In order to achieve these objectives as well as others that will become apparent with reference to the following specification, the present invention provides a gemstone and a method for making the gemstone. In one arrangement, the gemstone includes a crown portion and a girdle portion abutting the crown portion and extending along a predetermined plane. The crown portion has a plurality of crown facets provided on a surface thereof. The crown portion and the girdle portion each have eight longitudinal sections. At least one of the eight longitudinal sections of the crown portion have a first facet of the crown facets having a first edge bordering the girdle portion, and a second facet of the crown facets having a second edge bordering the girdle portion. A particular portion of the first edge abuts the second edge at a particular location. The first and second edges curve toward a center of the gemstone which is provided on the particular plane. The particular location is closer to the center of the gemstone than another portion of the first edge. Preferably, a particular portion of the second edge abuts the first edge at the particular location, and the particular location is closer to the center of the gemstone than another portion of the second edge. Advantageously, a pavilion portion including a number of pavilion facets provided on the surface thereof, and the girdle portion abuts with the pavilion portion and extends along the predetermined plane.

In an especially preferred arrangement, the pavilion portion of the gemstone has eight longitudinal sections, wherein at least one of the eight longitudinal sections of the pavilion portion has a third facet of the pavilion facets having a third edge bordering the girdle portion and a fourth facet of the pavilion facets having a fourth edge bordering the girdle portion. A particular portion of the third edge abuts the fourth edge at a further location. The third and fourth edges curve toward the center of the gemstone provided on the particular plane. The further location is closer to the center of the gemstone than another portion of the third edge. Preferably, a particular portion of the fourth edge abuts the third edge at the further location, and the further location is closer to the center of the gemstone than another portion of the fourth edge.

In accordance with another preferred arrangement, a method of making the gemstone is provided. According to the method, the gemstone is provided with a crown portion and a girdle portion, the crown portion extending along a predetermined plane, a first facet of the crown portion has a first edge abutting the girdle portion of the gemstone. A second facet of the crown portion of the gemstone has a second edge abutting the girdle portion of the gemstone, wherein a particular portion of the first edge abuts the second edge at a particular location. The method executes successive cuts in the gemstone such that the first edge and the second edge curve towards a center of the gemstone wherein the center is provided on the particular plane, and wherein the particular location is closer to the center of the gemstone than another portion of the first edge.

In accordance with another preferred arrangement, the gemstone includes a crown portion including a plurality of crown facets provided on a surface thereof, and a girdle portion abutting the crown portion and extending along a predetermined plane. The crown portion and the girdle portion of the gemstone each have at least five lobes. Advantageously, a pavilion portion including a plurality of pavilion facets provided on the surface thereof. The girdle portion abuts with the pavilion portion and extends along the predetermined plane. The pavilion portion has at least five lobes.

BRIEF DESCRIPTION OF THE DRAWINGS

Further objects, features, and advantages of the present invention will become apparent upon consideration of the following detailed description of the presently preferred embodiments when taken in conjunction with the accompanying drawings, wherein.

DETAILED DESCRIPTION

Figure 7:
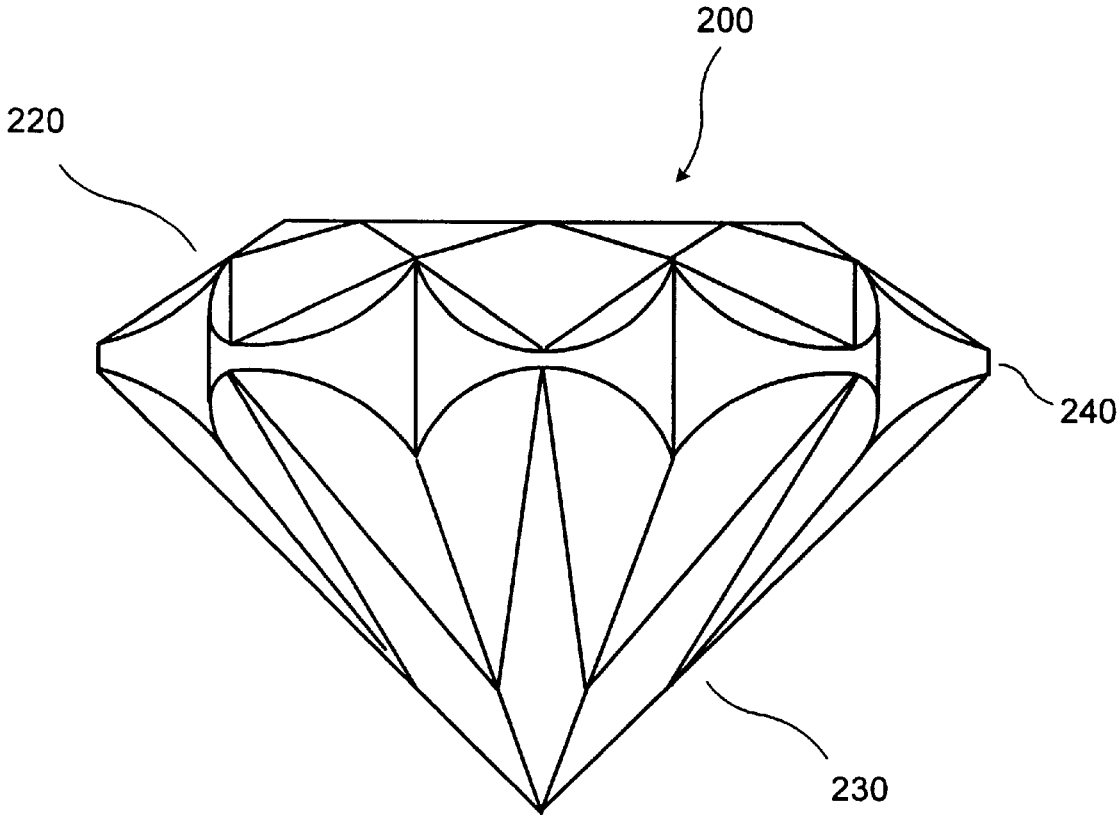
FIG. 7 shows an enlarged side view of an exemplary embodiment of the gemstone according to the present invention.

An exemplary embodiment of a gemstone 200 according to the present invention is shown in FIGS. 7–14. FIG. 7 shows an enlarged side view of the gemstone 200 which has an eight-lobed shape as viewed from the top or the bottom (e.g., see FIGS. 8 and 9). However, it is possible that another embodiment of the gemstone 200 of the present invention may have other shapes (e.g., a five-lobed shape, a six-lobed shape, a seven-lobed shape, a nine-lobed shape, etc.). It is also possible that still another embodiment of the gemstone 200 of the present invention may have an eight lobed shape when viewed from the top but not when viewed from the bottom, and vice versa. The gemstone 200 can be a precious stone (such as a diamond) or a semi-precious stone.

Figure 2:
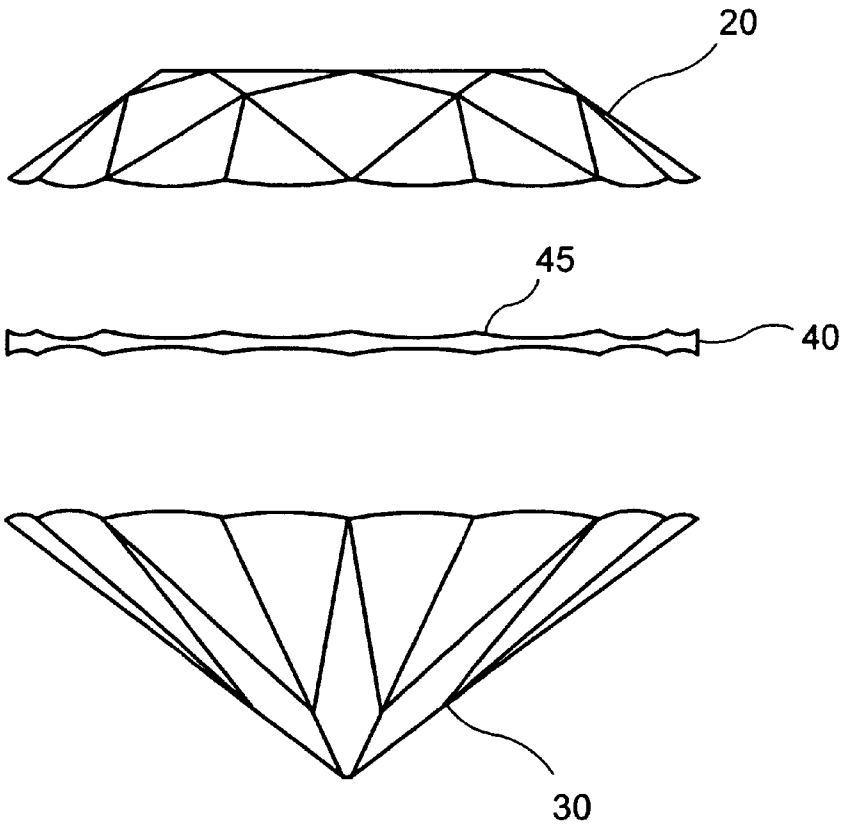
FIG. 2 PRIOR ART
FIG. 2 shows a side view of different portions of the conventional gemstone.
Figure 1:
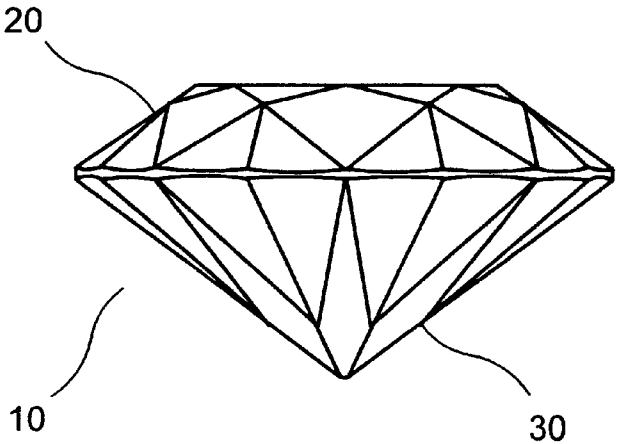
FIG. 1 PRIOR ART
FIG. 1 shows a side view of a conventional gemstone.
Figure 3:
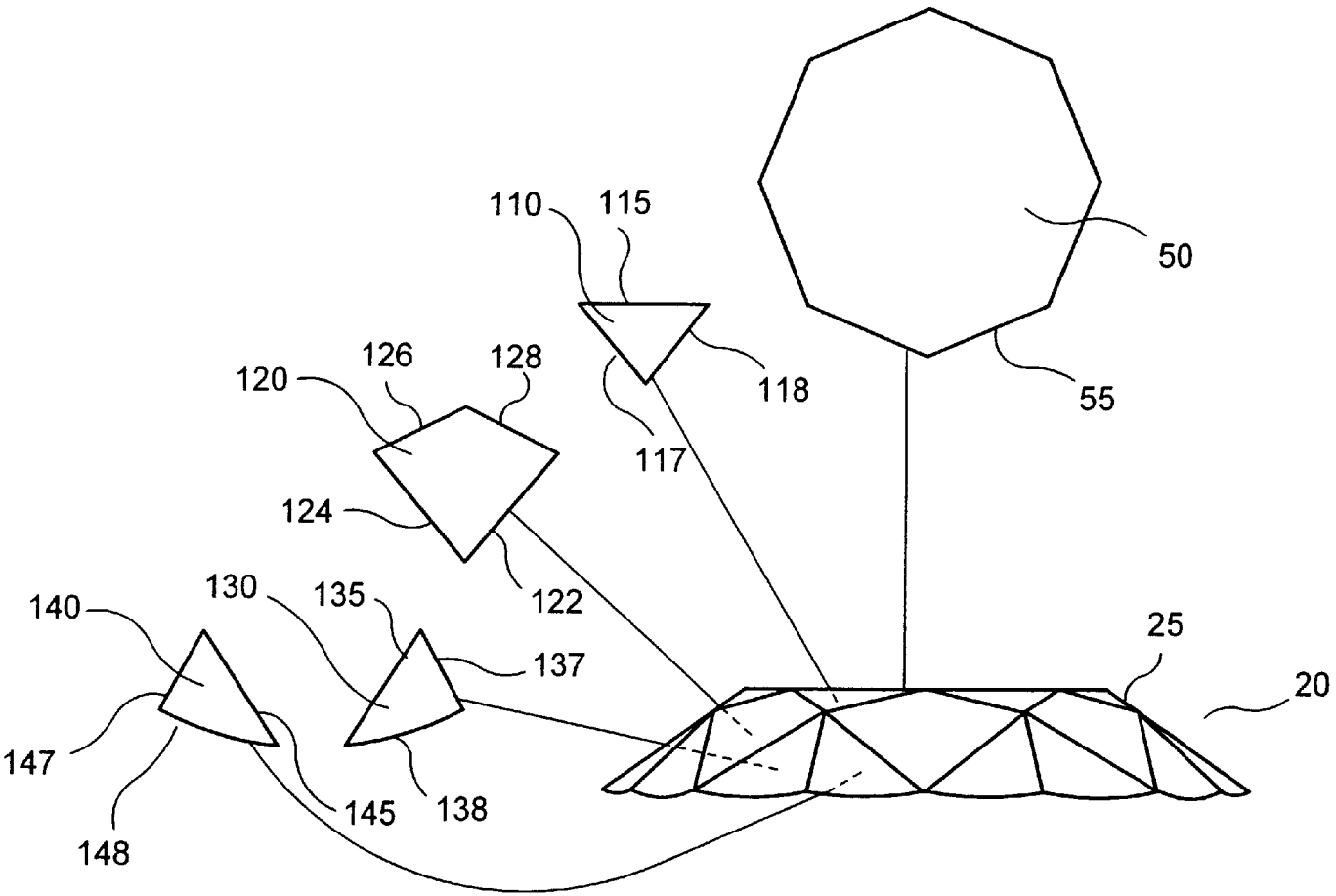
FIG. 3 PRIOR ART
FIG. 3 shows an enlarged side view of a crown of the conventional gemstone of FIG. 1 and facets provided on the crown.
Figure 4:
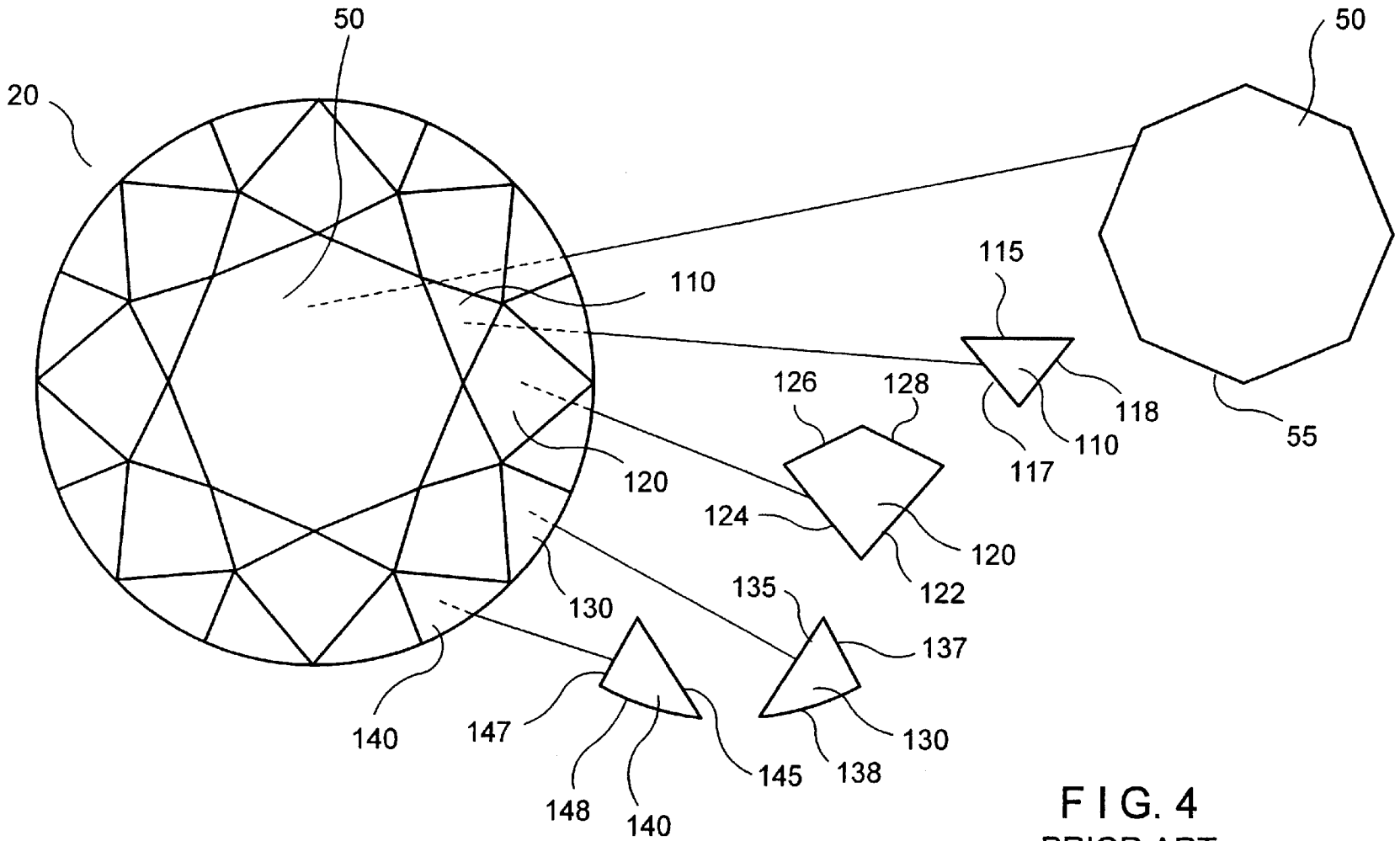
FIG. 4 PRIOR ART
FIG. 4 shows an enlarged top view of the crown of the conventional gemstone of FIG. 1 and facets provided on the crown.
Figure 6:
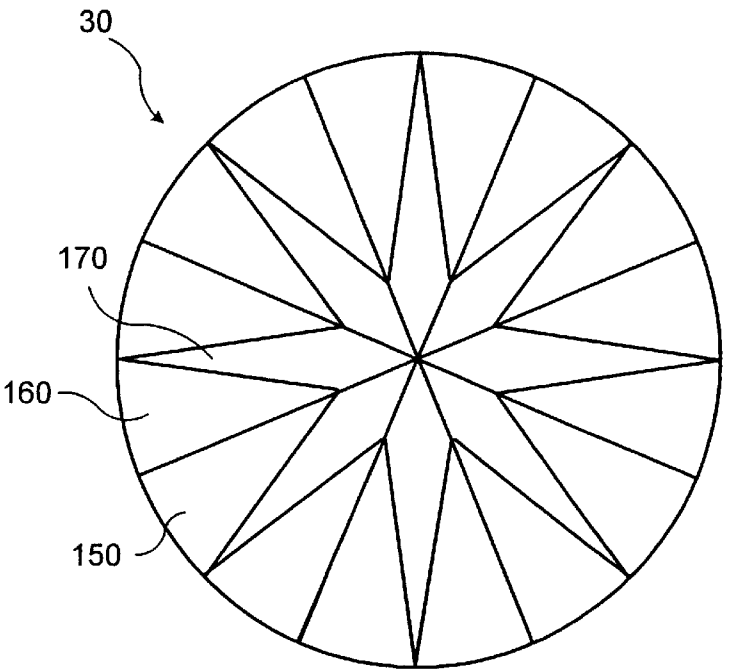
FIG. 6 PRIOR ART
FIG. 6 shows an enlarged bottom view of the pavilion of the conventional gemstone of FIG. 1.
Figure 5:
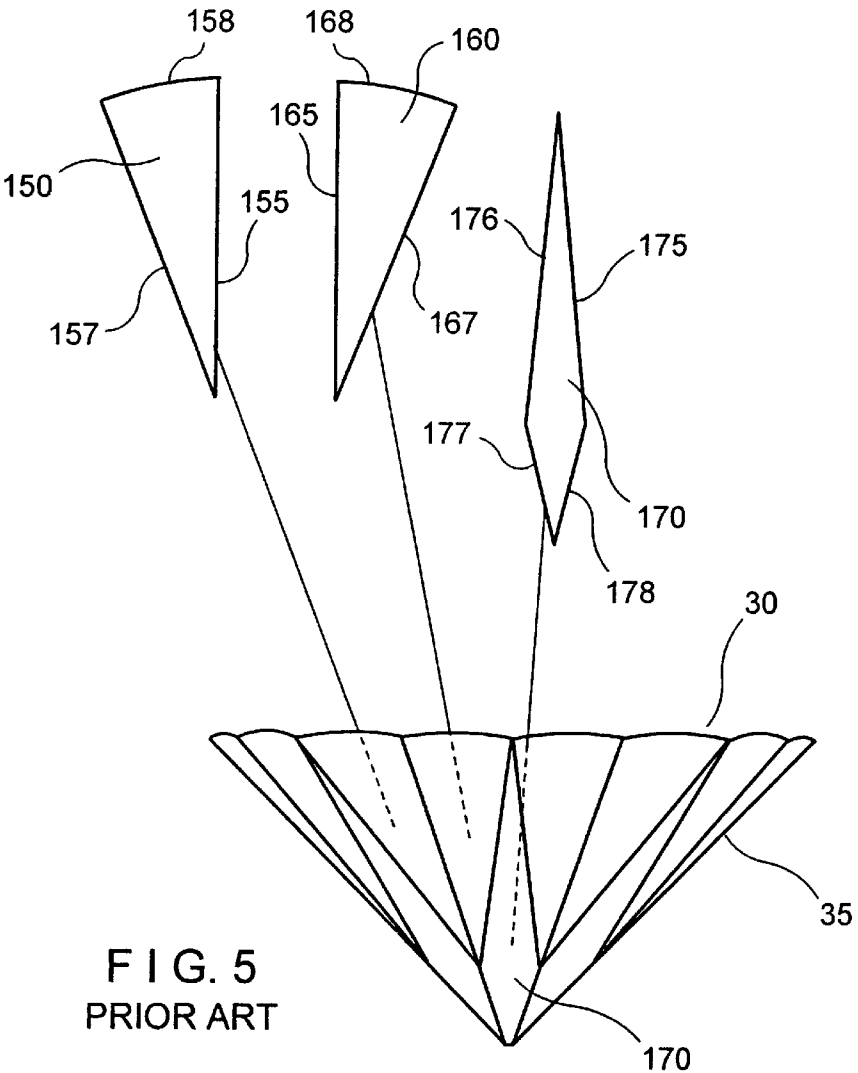
FIG. 5 PRIOR ART
FIG. 5 shows an enlarged side view of a pavilion of the conventional gemstone of FIG. 1 and facets provided on the crown.
Figure 8:
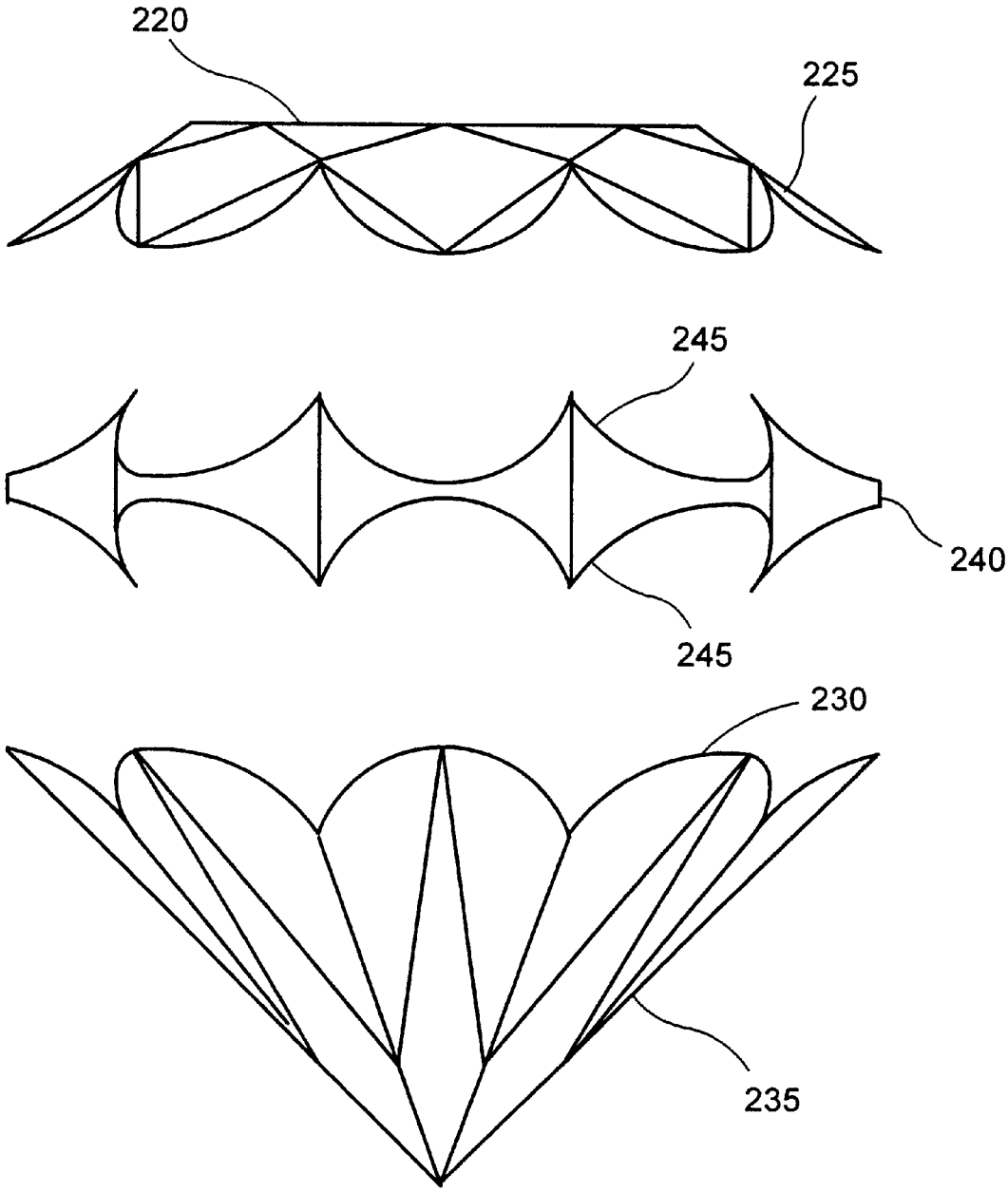
FIG. 8 shows a side view of the different portions of the gemstone of FIG. 7.

Similarly to the conventional gemstone 10 of FIG. 1, the gemstone 200 according to the present invention as illustrated in FIGS. 7 and 8 includes a crown 220, a pavilion 230, a girdle 240, and particular facets provided on the crown 220 and the pavilion 230. The crown 220 is provided above the pavilion 230, and is separated from the pavilion 230 by the girdle 240. The crown 220 and the pavilion 230 have particular facets provided thereon. As known to those having ordinary skill in the art, these facets are arranged to enhance the appearance of the gemstone 200. Unlike the conventional gemstone 10 of FIG. 1, the gemstone 200 according to the present invention has particular facets provided upon the girdle. FIG. 8 shows separate enlarged portions of the gemstone 200, i.e. the crown 220, the pavilion 230 and of the girdle 240.

Figure 9:
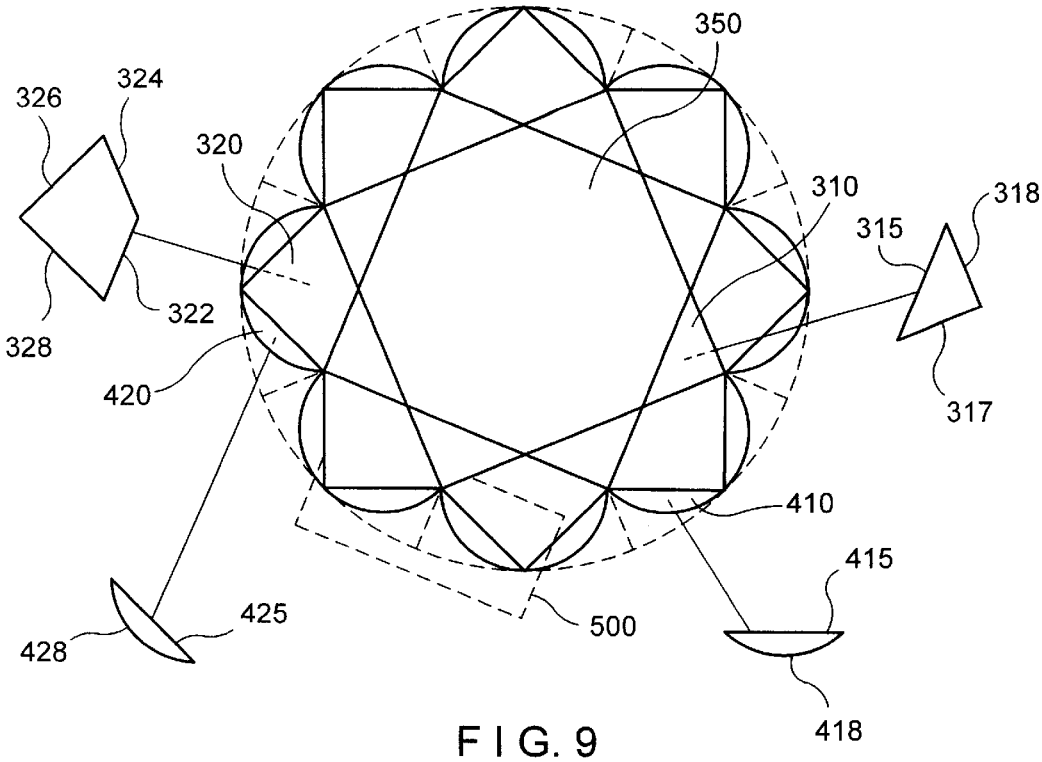
FIG. 9 shows an enlarged top view of the gemstone illustrated in FIG. 7.

FIG. 9 shows an enlarged top view of the crown 220 of the gemstone 200. The crown 220 preferably includes a flat table 350 which has a shape of an octagon and is disposed on top to the crown 220 substantially in the horizontal plane. In addition, facets are provided on a diagonally-extending side 225 of the crown 220 (as shown in FIG. 8). These facets include star facets 310 (each having a shape of a triangle), upper main facets 320 (each having four sides), left-side upper round girdle facets 420, and right-side upper round girdle facets 410. The crown generally has eight star facets 310, eight upper main facets 320, eight left-side upper round girdle facets 420 and eight right-side upper round girdle facets 410. Accordingly, the crown 220 has a total of thirty-two facets and the table 350 (which can be considered as another facet) provided thereon.

The longest edges 315 of the star facets 310 form edges of the table 350. A right edge 318 of each star facet 310 forms a shorter left edge 324 of a respective upper main facet 320. A left edge 317 of each star facet 310 forms a shorter right edge 322 of another upper main facet 320. A right edge 425 of each left-side upper round girdle facet 420 forms a longer left edge 328 of a respective upper main facet 320, while a left edge 428 of the same left-side upper round girdle facet 420 forms an upper edge 245 of the girdle 240. A left edge 415 of each right-side upper round girdle facet 410 forms a longer right edge 326 of a respective upper main facet 320, while a right edge 418 of the same right-side upper round girdle facet 41 0 forms an upper edge 245 (FIG. 8) of the girdle 240.

Figure 10:
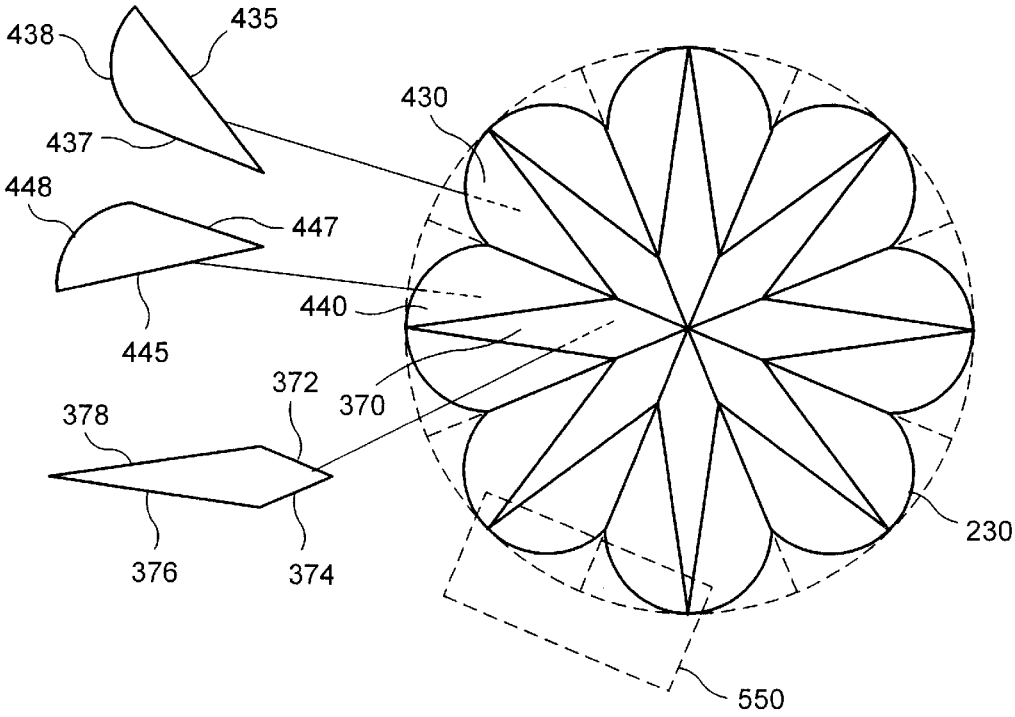
FIG. 10 shows an enlarged bottom view of the gemstone illustrated in FIG. 7.

FIG. 10 shows an enlarged bottom view of the pavilion 230 of the gemstone 200. The pavilion 230 includes facets on a diagonally-extending side 235 of the pavilion 230. These facets include left-side lower round girdle facets 430, right-side lower round girdle facets 440, and lower main facets 370 (each having four sides). The pavilion generally has eight left-side lower round girdle facets 430, eight right-side lower round girdle facets 440, and eight lower main facets 370. Accordingly, the pavilion 230, preferably has a total of twenty-four (24) facets provided thereon.

Each of the left edge 435 of the left-side lower round girdle facets 430 forms the longer right edge 376 of the respective lower main facet 370. Each of the right edge 437 of the left-side lower round girdle facets 430 abuts the left edge 447 of the right-side lower round girdle facets 440. Each of the right edge 445 of the right-side lower round girdle facet 440 form the longer left edge 378 of the respective lower main facet 370. Each of the shorter left edge 372 of the lower main facet 370 abuts the shorter right edge 374 of another lower main facet 370. Top edges 438 of the left-side lower round girdle facets 430 and top edges 448 of the right-side lower girdle facets 440 form a lower edge 248 of the girdle 240 (as shown in FIG. 8).

It should be noted that the facets 410, 420, 430, and 440 can be provided or produced by cutting particular sections of the crown 20, the pavilion 30, and the girdle 40 of the conventional gemstone 10. Each of the sections of the crown 20 to be cut are provided between one respective left-side upper girdle facet 130 and one respective right-side upper girdle facet 140 on the crown 20 of the conventional gemstone 10 and between one respective left-side lower girdle facet 150 and one respective right-side lower girdle facet 160 of the pavilion 30 of the conventional gemstone 10. These sections are preferably cut so that the portions of the respective left-side and right-side upper girdle facets 130, 140 have substantially equal but opposite surface areas, and the portions of the respective left-side and right-side lower girdle facets 150, 160 also have substantially equal but opposite surface areas. According to the present invention, the gemstone 10 is cut substantially along the vertical plane through the crown 20, the girdle 40, and the pavilion 30. Thus, the surface areas of the facets 410 and 420 should be substantially the same, and the surface areas of the facets 430 and 440 should also be substantially the same.

Figure 11:
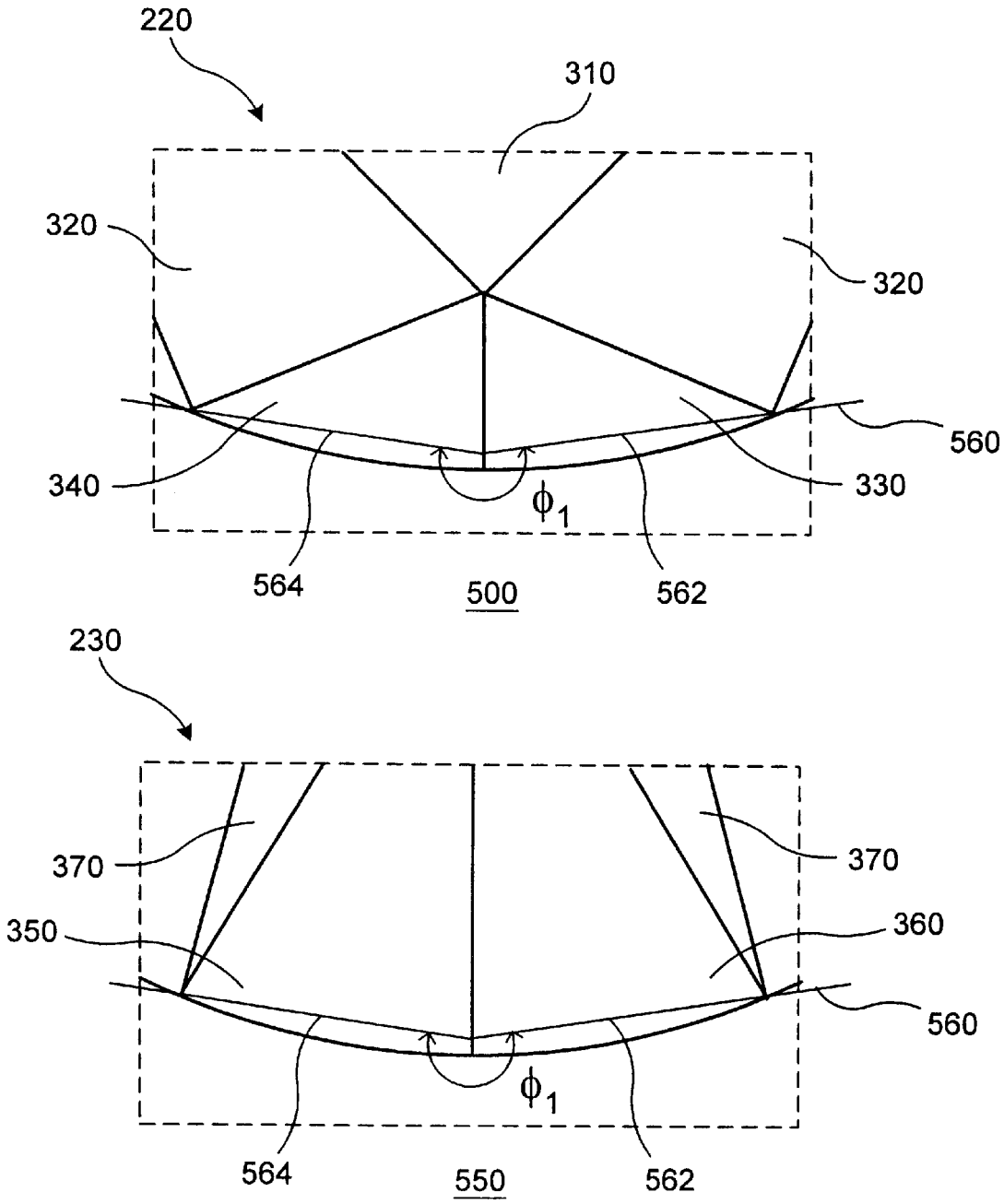
FIG. 11 shows yet further enlarged views of corresponding sections of the crown of the gemstone prior to any cutting thereof.

The facets 410, 420, 430, and 440 are provided by making a number of cuts through the gemstone 200, and the facets are provided in pairs. FIGS. 11–14 show the steps of the process for cutting the facets 410, 420, 430, 440 according to the present invention. FIG. 11 shows the first step (i.e., a first cut) for creating the rounded facets on the crown 220. A first dashed box 500 shows a portion of the crown 220, and a second dashed box 550 shows a portion of the pavilion 230. A cutting knife 560 is used to make the cut in the gemstone 200. The cutting knife 560 has two portions i.e., a left portion 562 and a right portion 564. The right portion 562 and the left portion 564 are first positioned at an obtuse angle $\theta_1$. The center of the cutting knife 560 is positioned at the edge between a left-side upper girdle facet 340 and a right-side upper girdle facet 330. The right portion 562 of the cutting knife 560 extends over the right-side upper girdle facet 330 to the edge between the right-side upper girdle facet 330, the upper main facet 320, and the girdle 240. The left portion 562 of the cutting knife 560 extends over the left-side upper girdle facet 330 to the edge between the left-side upper girdle facet 330, the upper main facet 320, and the girdle 240. The cut is made into the crown 220, the girdle 240, and the pavilion 230 of the gemstone 200 substantially along the vertical plane of the gemstone 200.

Figure 12:
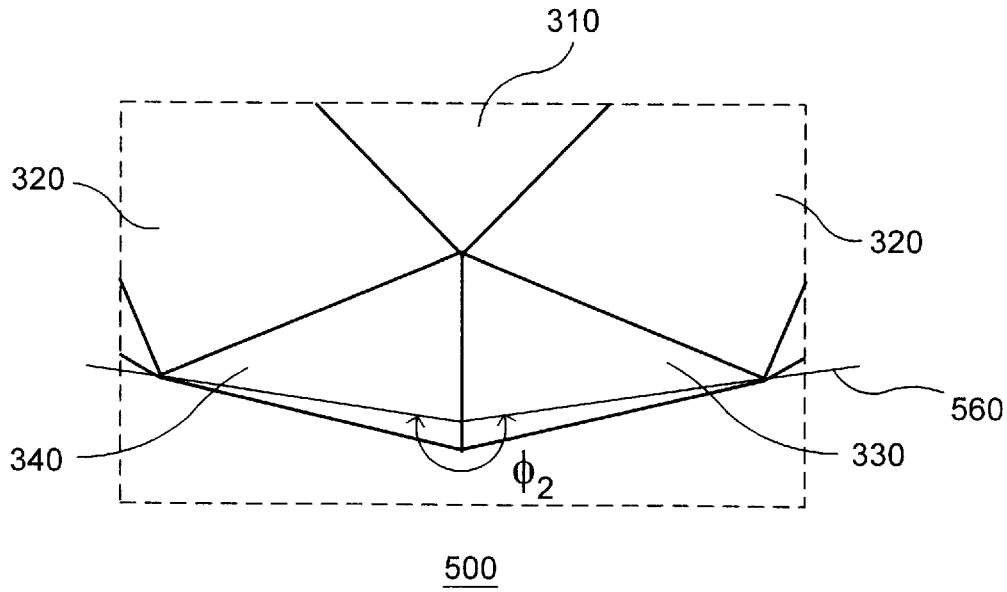
FIG. 12 shows the corresponding sections of the crown and pavilion of FIG. 11 after a portion thereof is cut.
Figure 12:
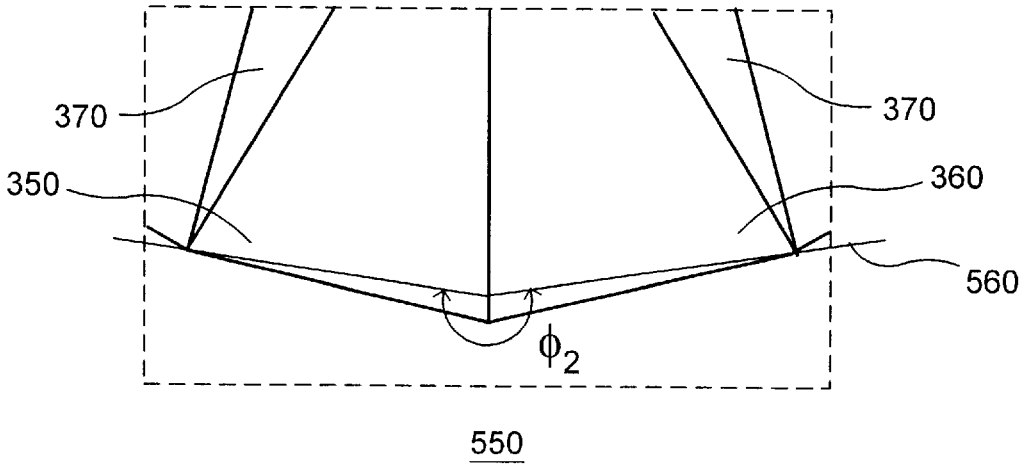

FIG. 12 shows the second step (i.e. a second cut) to create the rounded facets 410, 420, 430, and 440 of the gemstone according to the present invention. The first dashed box 500 shows an enlarged portion of the crown 220, and the second dashed box 550 shows a portion of the pavilion 230. The angle $\theta_1$ between the left portion 564 and the right portion 562 of the cutting knife 560 is reduced to $\theta_2$. The center of the cutting knife 560 is then positioned between the facets 340, 330, and closer to the center of the gemstone 200. The right portion 562 and the left portion 564 of the cutting knife 560 extend over the respective right-side upper girdle facet 330 and the respective left-side upper girdle facet 340. The outer portions of the cutting knife 560 are preferably positioned closer together for the second cut. After the cutting knife 560 is repositioned, the second cut can be made.

Figure 13:
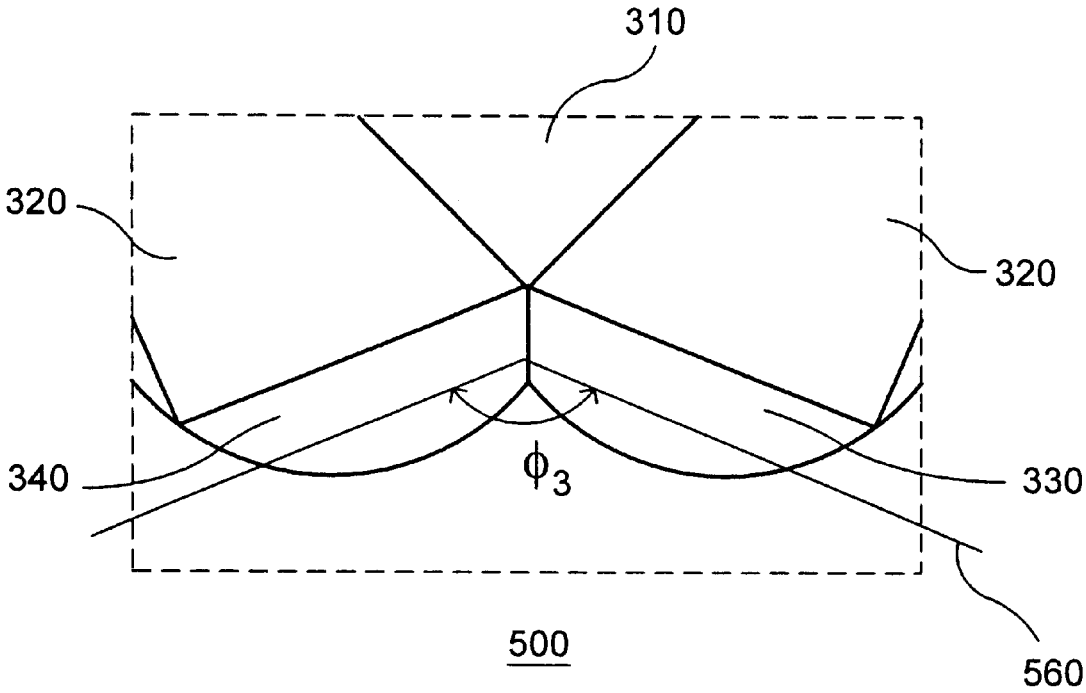
FIG. 13 shows the corresponding sections of the crown and pavilion of FIG. 11 after a further portion thereof is cut.
Figure 13:
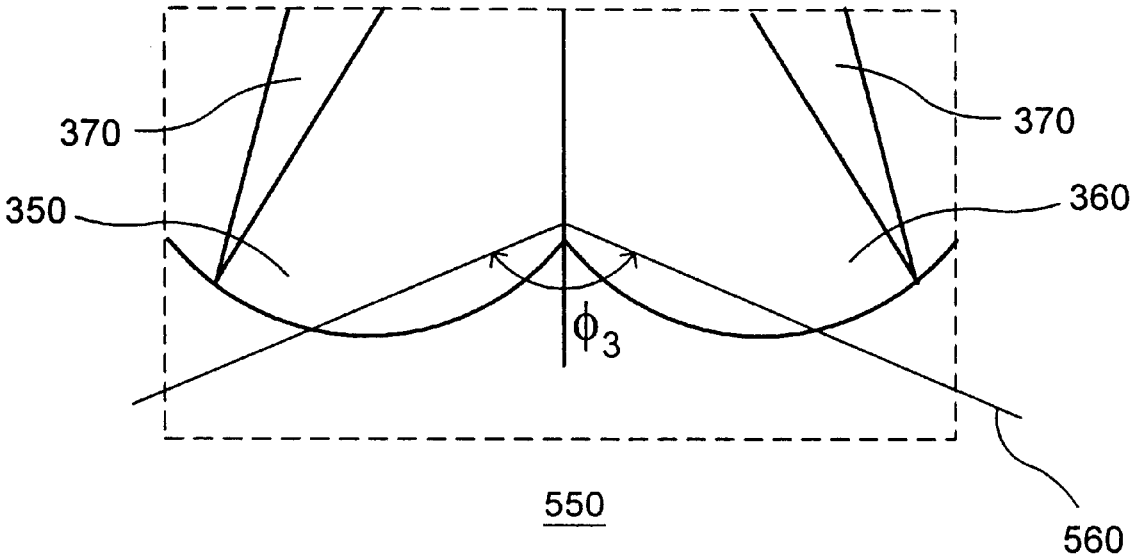

FIG. 13 shows another step of the method of the present invention, in which the cutting knife 560 makes another cut in the gemstone 200 to form the curved edges of facets 330, 340, 350 and 360. The angle $\theta_2$ between the left portion 564 and the right portion 562 of the cutting knife 560 is further reduced to $\theta_3$. The center of the cutting knife 560 is positioned between the facets 340, 330, and closer to the center of the gemstone 200. The right portion 562 and the left portion 564 of the cutting knife 560 extend over the respective right-side upper girdle facet 330 and the respective left-side upper girdle facet 340. The outer portions of the cutting knife 560 are preferably positioned closer together for the second cut at $\theta_3$. After the cutting knife 560 is repositioned, this cut can be made.

Figure 14:
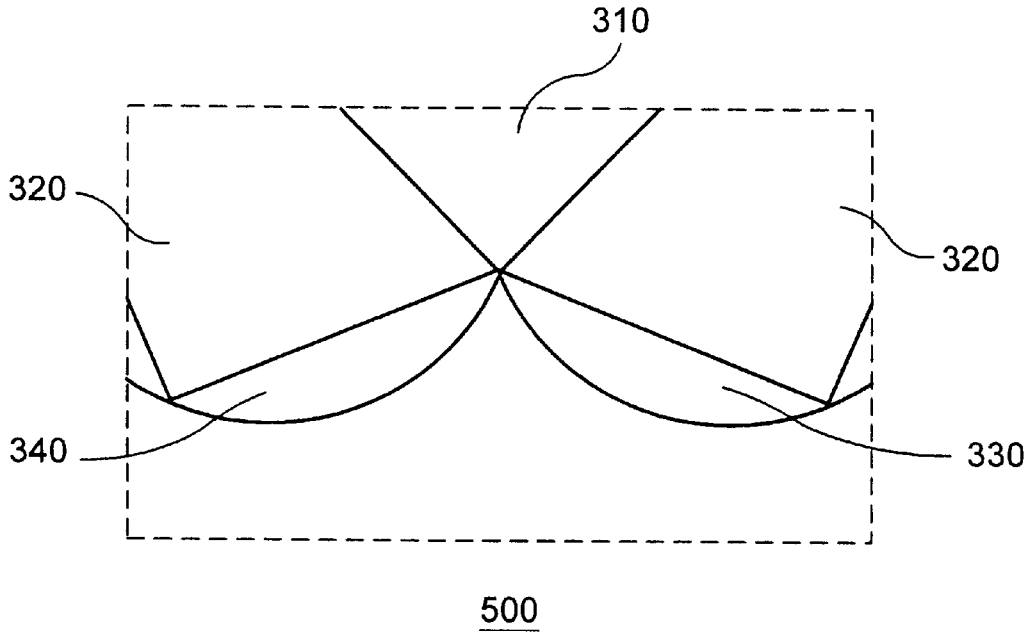
FIG. 14 shows the corresponding sections of the crown and pavilion of FIG. 11 after a still further portion thereof is cut.
Figure 14:
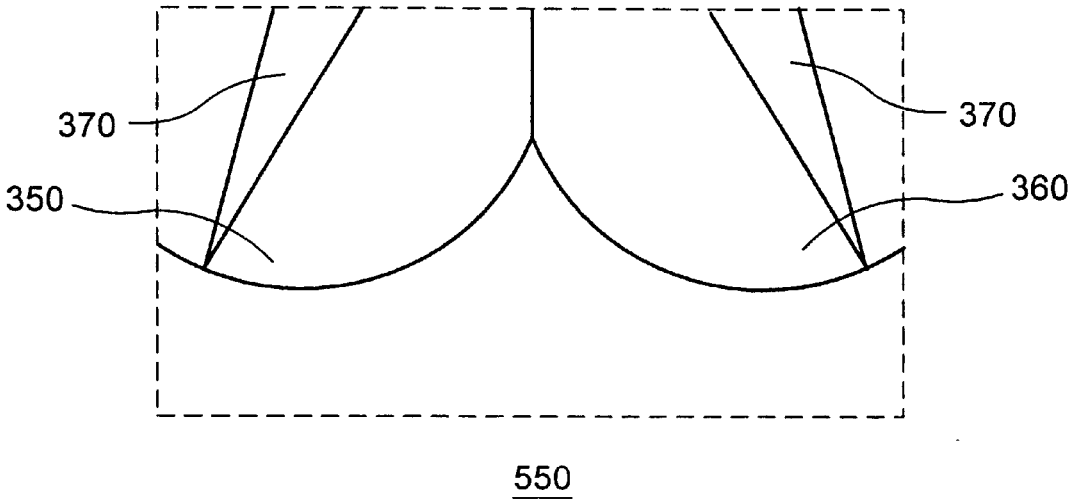

FIG. 14 shows the completed right-side upper round girdle 410, left-side upper round girdle 420, right-side lower round girdle 440, and left-side lower round girdle 430 of the gemstone 200. Using the method of the present invention, the edges of the right-side upper girdle facet 330 and the left-side upper girdle facet 340 which border on the girdle 240 are formed in a curved manner. Indeed, they curve toward a center of the gemstone 200. This process can be repeated at the juncture of any two facets.

Figure 15:
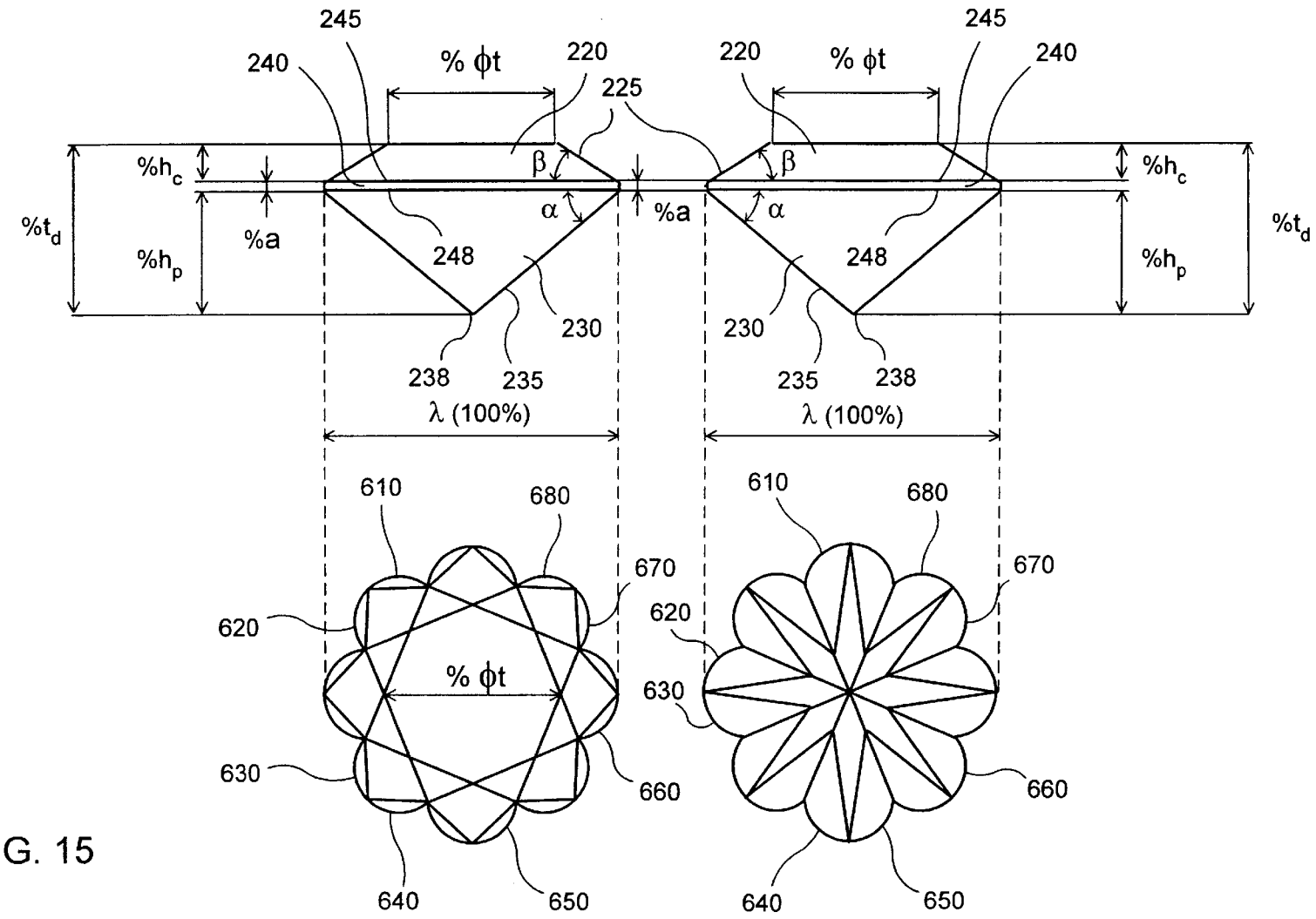
FIG. 15 shows a side view of the gemstone illustrated in FIG. 7 with relative dimensions of particular portions of the gemstone being provided.

To further explain the gemstone 200 of the present invention, the gemstone 200 can be conceptually subdivided into eight longitudinally-extending sections 610–680, as shown in FIG. 15. In particular when viewed from above, each section of the gemstone 200 includes at least one left-side upper round girdle facet 420, at least one right-side upper round girdle facet 410, at least one star facet 310, and at least one partial upper main facet 320. Thus, as viewed from the top, at least two facets 420, 410 of each section have edges that border the girdle 240. And when viewed from below, each section of the gemstone 200 includes at least one left-side lower round girdle facet 430, at least one right-side lower round girdle facet 440, and at least one partial lower main facet 370. Thus, as viewed from the bottom, at least two facets 430, 440 of each section have edges that border the girdle 240. According to the present invention, it is also conceivable that each of the sections 610–680 has other facets that border the girdle.

FIG. 15 also illustrates side views of the gemstone 200 according to the present invention with relative exemplary dimensions of particular portions of the gemstone being provided therein. In particular, the relative diameter $\lambda$ of the girdle 240 of the gemstone 200 is set at 100%, and extends in a direction A along the diameter $\lambda$. As such, the diameter $\lambda$ of the girdle 240 shall serve for the description below as a reference for other dimensions of the gemstone 200 according to the present invention. A diagonal side 225 of the crown 220 may extend at a crown angle $\beta$ of between approximately 32° and 37° as measured with respect to the upper edge 245 of the girdle 240. A diagonal side 235 of the pavilion 230 may extend at a pavilion angle $\alpha$ of between approximately 40° and 45° as measured with respect to the extension of the plane of the bottom edge 248 of the girdle 240.

A width $\Phi_t$ of the table 350 is approximately 53% to 66% in comparison with the diameter $\lambda$ of the girdle 240. The crown 220 has a crown height $h_c$ (measured from the table 350 of the crown 230 to an upper edge 243 of the girdle 240) of approximately 11% to 16% compared to the diameter $\lambda$ of the girdle 240. The girdle 240 has a girdle thickness a of approximately 2% to 5% in a relative comparison with the diameter $\lambda$ of the girdle 240. The pavilion 230 has a pavilion height $h_p$ (measured from a pointed portion 238 of the pavilion 230 to a lower edge 245 of the girdle 240) of approximately 40% to 45% compared to the diameter $\lambda$ of the girdle 240. A total height $h_d$ of the gemstone 200 (measured from the table 350 to the pointed portion 238 of the pavilion 230) may be approximately 56% to 65% compared to the diameter $\lambda$ of the girdle 240.

As an example, if the gemstone 200 has a carat weight of 2.5 carats, the diameter $\lambda$ of the girdle 240 may be 10 mm. Accordingly, the table width $\Phi_t$ can be between 5.3 mm and 6.6 mm, the crown height $h_c$ may be between 1.1 mm and 1.6 mm, the girdle thickness a may be between 0.2 mm and 0.5 mm, the pavilion height $h_p$ can be between 4.0 mm and 4.5 mm, and the total height $t_d$ is preferably between 5.6 mm and 6.5 mm.

The above-described relative dimensions are exemplary. Indeed, other crown, pavilion and middle facet angles, as well as different relative dimensions of the gemstone 200 are also conceivable, and are within the scope of the present invention. It should be appreciated that those skilled in the art will be able to devise numerous embodiments which, although not explicitly shown or described herein, embody the principles of the invention and are thus within the spirit and scope of the present invention.

What is claimed is:

1. A gemstone, comprising:

a crown portion including a plurality of crown facets provided on a surface thereof; and a girdle portion abutting the crown portion and extending along a predetermined plane, wherein the crown portion and the girdle portion each have eight longitudinal sections, wherein at least two sections of the eight longitudinal sections of the crown portion each include a respective first facet of the crown facets having a first edge bordering the girdle portion and a respective second facet of the crown facets having a second edge bordering the girdle portion, wherein a first portion of the first edge abuts the second edge at a particular location, wherein at the particular location, the first and second edges curve toward a center of the gemstone which is provided on the predetermined plane, and wherein the particular location is closer to the center of the gemstone than a second portion of the first edge.

2. The gemstone according to claim 1, further comprising:

a pavilion portion including a plurality of pavilion facets provided on a surface thereof, and the girdle portion abuts with the pavilion portion and extends along the predetermined plane.

3. The gemstone according to claim 2, wherein the pavilion portion has eight longitudinal sections, wherein at least two sections of the eight longitudinal sections of the pavilion portion each include a respective third facet of the pavilion facets having a third edge bordering the girdle portion and a fourth respective facet of the pavilion facets having a fourth edge bordering the girdle portion, wherein a first portion of the third edge abuts the fourth edge at a further location, wherein the third and fourth edges curve toward the center of the gemstone provided on the predetermined plane, and wherein the further location is closer to the center of the gemstone than a second portion of the third edge.

4. The gemstone according to claim 3, wherein the further location is closer to the center of the gemstone than a second portion of the fourth edge.

5. The gemstone according to claim 3, wherein the particular location and the further location are provided at the same distance from the center of the gemstone.

6. The gemstone according to claim 3, wherein the third edge and the fourth edge meet at a second particular angle.

7. The gemstone according to claim 3, wherein the third edge and the fourth edge are curved in different directions.

8. The gemstone according to claim 1, wherein each of the longitudinal sections includes a predetermined number of the crown facets.

9. The gemstone according to claim 1, wherein first four consecutive ones of the longitudinal sections define a first half of the crown portion, and second four consecutive ones of the longitudinal sections define a second half of the crown portion.

10. The gemstone according to claim 1, wherein all of the edges of first and second respective facets of each of the eight longitudinal sections that border the girdle portion collectively define an upper edge of the girdle portion.

11. The gemstone according to claim 1, wherein the first edge and the second edge meet at a first particular angle.

12. The gemstone according to claim 1, wherein the first edge and the second edge are curved in different directions.

13. A gemstone, comprising a crown portion including a plurality of crown facets provided on a surface thereof; and a girdle portion abutting the crown portion and extending along a predetermined plane, wherein the crown portion and the girdle portion each have eight longitudinal sections, wherein at least two sections of the eight longitudinal sections of the crown portion each include a respective first facet of the crown facets having a first edge bordering the girdle portion and a respective second facet of the crown facets having a second edge bordering the girdle portion, wherein a first portion of the first edge abuts the second edge at a particular location, wherein the first and second edges curve toward a center of the gemstone which is provided on the predetermined plane, and wherein the particular location is closer to the center of the gemstone than a second portion of the first edge and a second portion of the second edge.

14. A gemstone comprising, a crown portion including a plurality of crown facets provided on a surface thereof; and a girdle portion abutting the crown portion and extending along a predetermined plane, wherein the crown portion and the girdle portion each have at least five lobes, and wherein at least two neighboring ones of the lobes of the crown portion each include at least two distinct facets which contact the girdle portion.

15. The gemstone according to claim 14, further comprising:

a pavilion portion including a plurality of pavilion facets provided on a surface thereof, the girdle portion abutting the pavilion portion and extending along the predetermined plane, wherein the pavilion portion has at least five further lobes associated with the at least five lobes.

16. The gemstone according to claim 14, wherein the crown portion has seven or more lobes.

17. A gemstone, comprising:

a crown portion including a plurality of crown facets provided on a surface thereof; and a girdle portion abutting the crown portion and extending along a predetermined plane, wherein the crown portion and the girdle portion each have eight longitudinal sections, wherein at least one of the eight longitudinal sections of the crown portion includes a first facet of the crown facets having a first edge bordering the girdle portion and a second facet of the crown facets having a second edge bordering the girdle portion, wherein a first portion of the first edge abuts the second edge at a particular location, wherein at the particular location, the first and second edges curve toward a center of the gemstone which is provided on the predetermined plane, wherein the particular location is closer to a center of the gemstone than a second portion of the first edge, and wherein at least three of the crown facets border the particular location.

18. A gemstone, comprising:

a table portion;

a crown portion including a plurality of crown facets provided on a surface thereof; and a girdle portion abutting the crown portion and extending along a predetermined plane, wherein the crown portion and the girdle portion each have at least five lobes, and wherein at least one of the lobes of the crown portion includes at least one facet which contacts the table portion and the girdle portion.

* * * * *

UNITED STATES PATENT AND TRADEMARK OFFICE

CERTIFICATE OF CORRECTION

PATENT NO. : 6,401,489 B1
DATED : June 11, 2002
INVENTOR(S) : Nai Yan Cheng

It is certified that error appears in the above-identified patent and that said Letters Patent is hereby corrected as shown below:

Title page,
Item [56], References Cited, delete "FOREIGN PATENT DOCUMENTS SU 1466691 * 3/1989 … 63/32"

Column 3,
Lines 61, 64 and 67 "and" should be deleted

Column 4,
Line 64, "41 0" should read -- 410 --

Column 5,
Line 1, "diagonally-extending" should read -- diagonally extending --

Column 6,
Line 38, "longitudinally-extending" should read -- longitudinally extending --

Column 7,
Line 8, "a" should read -- α --

Signed and Sealed this

Eleventh Day of February, 2003

JAMES E. ROGAN
*Director of the United States Patent and Trademark Office*